US007065925B2

(12) United States Patent
Hansort

(10) Patent No.: US 7,065,925 B2
(45) Date of Patent: Jun. 27, 2006

(54) CONCRETE ANCHOR

(75) Inventor: Rens Hansort, Napperville, IL (US)

(73) Assignee: Universal Form Clamp of Chicago, Inc., Bellwood, IL (US)

( * ) Notice: Subject to any disclaimer, the term of this patent is extended or adjusted under 35 U.S.C. 154(b) by 0 days.

(21) Appl. No.: 10/776,906

(22) Filed: Feb. 11, 2004

(65) Prior Publication Data

US 2005/0183349 A1 Aug. 25, 2005

(51) Int. Cl.
*E02D 35/00* (2006.01)

(52) U.S. Cl. ..... 52/125.5; 52/700; 294/1.1; 294/89

(58) Field of Classification Search ..... 52/125.4, 52/125.5, 125.7, 127.2, 701, 707, 125.3, 52/700, 125.1, 704; 294/82.1, 89, 86.42, 294/1.1; 403/300; 405/275, 285; 16/444, 16/446; 114/218, 364
See application file for complete search history.

(56) References Cited

U.S. PATENT DOCUMENTS

| | | | | |
|---|---|---|---|---|
| 958,978 | A | 5/1910 | Spencer | |
| 1,056,955 | A | 3/1913 | Stamm | |
| 1,123,107 | A | 12/1914 | Darr | |
| 1,970,860 | A | 8/1934 | Lowell | |
| 1,984,211 | A | 12/1934 | Haase | |
| 2,163,446 | A | 6/1939 | Heckman | |
| 2,772,560 | A | 12/1956 | Neptune | |
| 2,886,370 | A | 5/1959 | Liebert | |
| 2,984,195 | A | 5/1961 | Duncan | |
| 3,297,293 | A * | 1/1967 | Andrews et al. | 248/499 |
| 3,499,676 | A | 3/1970 | Haeussler | |
| 3,652,118 | A | 3/1972 | Goldberg | |
| 3,861,106 | A | 1/1975 | Erhart | |
| 3,883,170 | A | 5/1975 | Fricker et al. | |
| 3,998,487 | A | 12/1976 | Biondo | |
| 4,000,591 | A | 1/1977 | Courtois | |
| 4,087,947 | A | 5/1978 | Turner | |
| 4,173,367 | A | 11/1979 | Haeussler | |
| 4,173,856 | A | 11/1979 | Fricker | |
| 4,262,951 | A | 4/1981 | Hoyer | |
| 4,290,638 | A | 9/1981 | Manning | |
| 4,296,909 | A * | 10/1981 | Haeussler | 249/94 |
| 4,329,826 | A | 5/1982 | Flogaus et al. | |
| 4,367,892 | A | 1/1983 | Holt | |
| 4,368,914 | A | 1/1983 | Truitt et al. | |
| 4,383,674 | A | 5/1983 | Fricker | |

(Continued)

FOREIGN PATENT DOCUMENTS

| | | |
|---|---|---|
| DE | 1 684 278 | 6/1967 |

(Continued)

OTHER PUBLICATIONS

Dayton Superior, Precast-Prestressed Concrete Handbook, 1986, 6 pages.

(Continued)

*Primary Examiner*—Naoko Slack
(74) *Attorney, Agent, or Firm*—Jeffrey D. Peterson; Michael Best & Friedrich LLP

(57) ABSTRACT

A concrete anchor. The concrete anchor can be embedded within a concrete member to enhance lifting of the concrete member. The concrete anchor of the present invention can include a bar having a first end, a second end positioned adjacent the first end, and an intermediate portion curved to at least partially define an aperture. The aperture can be adapted to engage lifting hardware. The concrete anchor can further include a stem and a foot. The stem can include a first end coupled to the first end and the second end of the bar, and a second end coupled to the foot.

24 Claims, 3 Drawing Sheets

U.S. PATENT DOCUMENTS

| | | | | | |
|---|---|---|---|---|---|
| 4,386,486 | A | | 6/1983 | Holt et al. | |
| 4,398,762 | A | | 8/1983 | Haeussler et al. | |
| D272,517 | S | | 2/1984 | Koehn | |
| 4,437,642 | A | | 3/1984 | Holt | |
| 4,466,569 | A | | 8/1984 | Taylor | |
| 4,538,850 | A | | 9/1985 | De Vito | |
| 4,580,378 | A | | 4/1986 | Kelly et al. | |
| 4,603,522 | A | | 8/1986 | Johnson | |
| 4,615,554 | A | | 10/1986 | Schilla et al. | |
| 4,627,198 | A | | 12/1986 | Francies, III | |
| 4,634,326 | A | * | 1/1987 | Fischer | 411/54 |
| 4,655,015 | A | | 4/1987 | Hoyer | |
| 4,671,554 | A | | 6/1987 | Lancelot | |
| 4,702,045 | A | | 10/1987 | Fricker | |
| 4,703,595 | A | | 11/1987 | Zipf et al. | |
| 4,713,856 | A | | 12/1987 | Clausen | |
| 4,726,562 | A | | 2/1988 | Courtois et al. | |
| 4,769,960 | A | | 9/1988 | Zipf et al. | |
| 4,807,843 | A | | 2/1989 | Courtois et al. | |
| 4,821,994 | A | | 4/1989 | Fricker | |
| 4,869,042 | A | | 9/1989 | Fricker | |
| 4,930,269 | A | | 6/1990 | Kelly et al. | |
| 4,947,613 | A | | 8/1990 | Fricker | |
| 5,004,208 | A | | 4/1991 | Domizio | |
| 5,014,473 | A | | 5/1991 | Kelly et al. | |
| 5,042,219 | A | | 8/1991 | Fricker | |
| 5,094,047 | A | | 3/1992 | Kelly et al. | |
| 5,155,954 | A | | 10/1992 | Roire | |
| 5,177,928 | A | | 1/1993 | Fricker | |
| 5,226,265 | A | | 7/1993 | Kelly et al. | |
| D344,836 | S | | 3/1994 | Huffman | |
| 5,396,743 | A | | 3/1995 | Bellette | |
| 5,431,368 | A | | 7/1995 | Wilde | |
| 5,469,675 | A | * | 11/1995 | Arteon | 52/125.5 |
| 5,535,979 | A | | 7/1996 | Ellis-Callow | |
| D374,394 | S | * | 10/1996 | Lynch et al. | D8/400 |
| 5,588,263 | A | | 12/1996 | Kelly et al. | |
| 5,596,846 | A | | 1/1997 | Kelly | |
| 5,651,911 | A | | 7/1997 | Pennypacker | |
| D389,251 | S | | 1/1998 | Kelly | |
| D392,752 | S | | 3/1998 | Kelly et al. | |
| 5,809,703 | A | | 9/1998 | Kelly | |
| 5,852,907 | A | | 12/1998 | Tobin et al. | |
| 5,857,296 | A | | 1/1999 | Niday et al. | |
| 5,884,438 | A | | 3/1999 | Westhoff et al. | |
| 5,987,830 | A | | 11/1999 | Worley | |
| D422,894 | S | | 4/2000 | Kubica | |
| 6,082,700 | A | | 7/2000 | Lancelot, III et al. | |
| 6,092,849 | A | | 7/2000 | Zambelli et al. | |
| 6,119,431 | A | | 9/2000 | Wakai | |
| 6,131,976 | A | | 10/2000 | Silva | |
| D437,063 | S | | 1/2001 | Lancelot, III et al. | |
| D438,649 | S | | 3/2001 | Lancelot et al. | |
| D438,991 | S | | 3/2001 | Lancelot, III et al. | |
| 6,233,883 | B1 | | 5/2001 | Artdon | |
| 6,260,900 | B1 | * | 7/2001 | Scott | 294/89 |
| 6,341,452 | B1 | | 1/2002 | Bollinghaus | |
| 6,343,444 | B1 | | 2/2002 | Minami | |
| 6,460,824 | B1 | | 10/2002 | Lancelot, III et al. | |
| 6,550,834 | B1 | | 4/2003 | Fromelius | |
| 6,581,996 | B1 | | 6/2003 | Fromelius | |
| 6,647,674 | B1 | * | 11/2003 | Lancelot et al. | 52/125.4 |
| 6,694,680 | B1 | | 2/2004 | Zambelli et al. | |
| 6,729,079 | B1 | | 5/2004 | Francies, III et al. | |
| 2003/0213206 | A1 | | 11/2003 | Hansort | |

FOREIGN PATENT DOCUMENTS

| | | | |
|---|---|---|---|
| DE | 1 800 807 | | 10/1968 |
| DE | 2 223 519 | | 5/1972 |
| DE | 2 610 195 | | 3/1976 |
| DE | 3 515 894 | | 11/1986 |
| EP | 0 568 934 | A2 | 4/1993 |
| EP | 634531 | A1 | 4/1994 |
| FR | 2 586 442 | | 8/1985 |
| GB | 408.235 | | 9/1932 |
| IT | 269410 | | 11/1929 |

OTHER PUBLICATIONS

Dayton Superior, Tilt-up Construction Handbook, 1990, 10 pages.

* cited by examiner

CONCRETE ANCHOR

BACKGROUND OF THE INVENTION

The present invention generally relates to a concrete anchor that can be embedded in a concrete form, such as a pre-cast or tilt-up wall. The concrete anchor of the present invention allows concrete forms, such as walls, to be positioned by the use of standard lifting equipment (e.g., cranes with cable attachments, etc.) by embedding the concrete anchor in a concrete form and coupling the lifting equipment to the concrete anchor.

Concrete anchors can be fabricated by a variety of means. For example, some existing concrete anchors are stamped out of strip steel. Depending on the physical properties of the concrete anchors (e.g., weight, thickness, shape, % material removed, etc.), concrete anchors can have a strength of 2-ton, 4-ton or 8-ton with a 4:1 safety factor.

SUMMARY OF INVENTION

In one embodiment of the invention, the anchor includes a bar having a first end, a second end positioned adjacent the first end, and an intermediate portion curved to at least partially define an aperture. The aperture can be adapted to engage lifting hardware. The anchor can further include a stem and a foot. The stem can include a first end coupled to the first end of the bar and the second end of the bar, and a second end coupled to a foot.

In another embodiment of the invention, the anchor includes a ring-shaped bar at least partially defining an aperture therethrough, the ring-shaped bar having a first end, and a second end positioned adjacent the first end. The anchor can further include a foot coupled to the first end and the second end of the ring-shaped bar.

Other features and aspects of the invention will become apparent to those skilled in the art upon review of the following detailed description and drawings.

Figure 1:
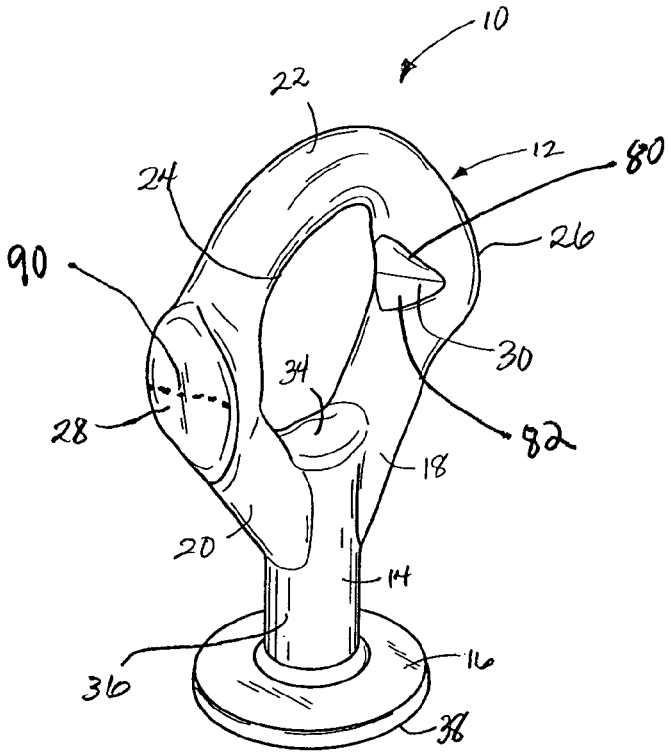
FIG. 1 is a perspective view of one embodiment of a concrete anchor of the present invention.

Before the embodiments of the invention are explained in detail, it is to be understood that the invention is not limited in its application to the details of construction and/or the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof, as well as additional items and equivalents thereof. Furthermore, terms such as "front," "rear," "top," "bottom," "side," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

DETAILED DESCRIPTION

The present invention is generally directed to a concrete anchor. The concrete anchor of the present invention can be fabricated by a variety of methods, including drop-forging and casting. The concrete anchor of the present invention can be formed of a variety of materials, including at least one of various steels, irons and the like. For example, the concrete anchor can be formed of a 90,000-psi steel that allows the anchor a 3-ton, 6-ton, or 10-ton capacity with a 4:1 safety factor. Anchors of increasing thickness can allow for a greater weight capacity to be achieved.

FIGS. 1–5 illustrate an anchor 10 according to one embodiment of the present invention. The anchor 10 includes a ring-shaped bar 12, a stem 14 and a foot 16. The bar 12 includes a first end 18 positioned adjacent the stem 14, and a second end 20 positioned adjacent the stem 14, opposite the first end 18. The bar 12 further includes an intermediate portion 22 which has a cross-sectional width 92, the intermediate portion 22 being is curved to at least partially define an aperture 24. The aperture 24 can be formed in the anchor 10 during manufacturing of the anchor 10 (e.g., during forging or casting of the anchor 10).

The bar 12 further includes a first flat side 26 and a second flat side 28, each of the first and second flat sides 26 and 28 being oriented substantially vertically and formed in an outer portion of the bar 12 (i.e., opposite an inner portion of the bar 12 that defines the aperture 24). Each of the flat sides have a width 90. The bar further includes a first indentation 30 positioned opposite the first flat side 26 of the bar 12, facing the aperture 24. The bar further includes a second indentation 32 positioned opposite the second flat side 28 of the bar 12, facing the aperture 24.

The stem 14 includes an upper end 34 coupled to the first end 18 and the second end 20 of the bar 12, and a lower end 36 coupled to the foot 16. In some embodiments, as illustrated in FIGS. 1–5, the stem 14 can be integrally formed with the bar 12 at the upper end 34 of the stem 14, and integrally formed at the lower end 36 with the foot 16. In other embodiments, the bar 12 and/or the foot 16 can be coupled to the upper end 34 of the stem 14 and/or the lower end 34 of the stem 14, respectively, via a variety of securing means, including, but not limited to, at least one of a fastener (e.g., one or more nails, screws, tacks, staples, bolts, etc.), welding (e.g., by tack welding, etc.), soldering, a press-fit engagement, a snap-fit engagement, or a variety of adhesives known to those of ordinary skill in the art.

The bar 12 and the stem 14 of the embodiment illustrated in FIGS. 1–5 have the same cross-sectional shape and dimension. However, the bar 12 and the stem 14 do not need to have the same cross-sectional shape or dimension. The stem 14 is illustrated in FIGS. 1–5 as comprising a cylinder, having a uniform cross-sectional shape. However, the stem 14 does not necessarily have a uniform cross-sectional shape. For example, the stem 14 can be conical, frustoconical, box shaped, pyramidal, can have a larger cross-sectional dimension at the upper and lower ends 34 and 36 and a smaller cross-section dimension in between the upper and lower ends 34 and 36, and the like.

It should be noted that the anchor 10 can be designed without the stem 14. That is, the first end 18 and the second end 20 can extend downwardly and be coupled to the foot 16 (i.e., integrally or otherwise).

Figure 4:
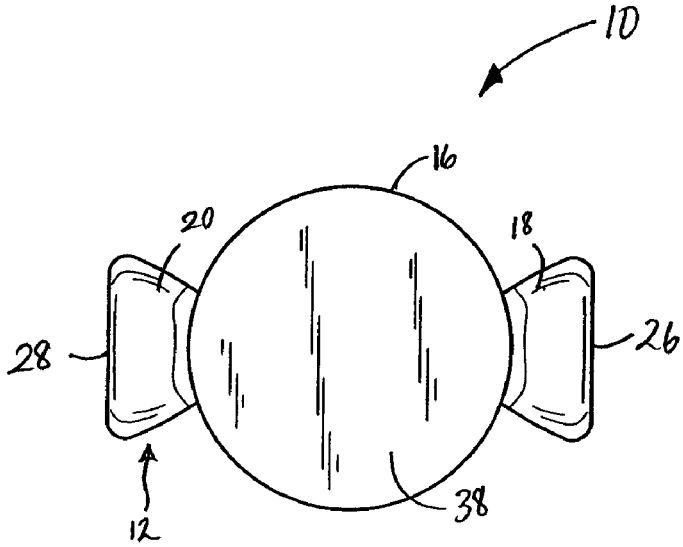
FIG. 4 is a bottom view of the concrete anchor of FIG. 1.

The foot 16, as illustrated in FIGS. 1–5 has a generally frustoconical shape, with a circular bottom 38 (as shown in FIG. 4). It should be noted, however, that the foot 16 can alternatively be conical, pyramidal, cylindrical, and the like. It should be further noted that the bottom 38 of the foot 16 can have a variety of shapes, including, but not limited to, square, rectangular, oval, triangular, trapezoidal, and the like.

Figure 2:
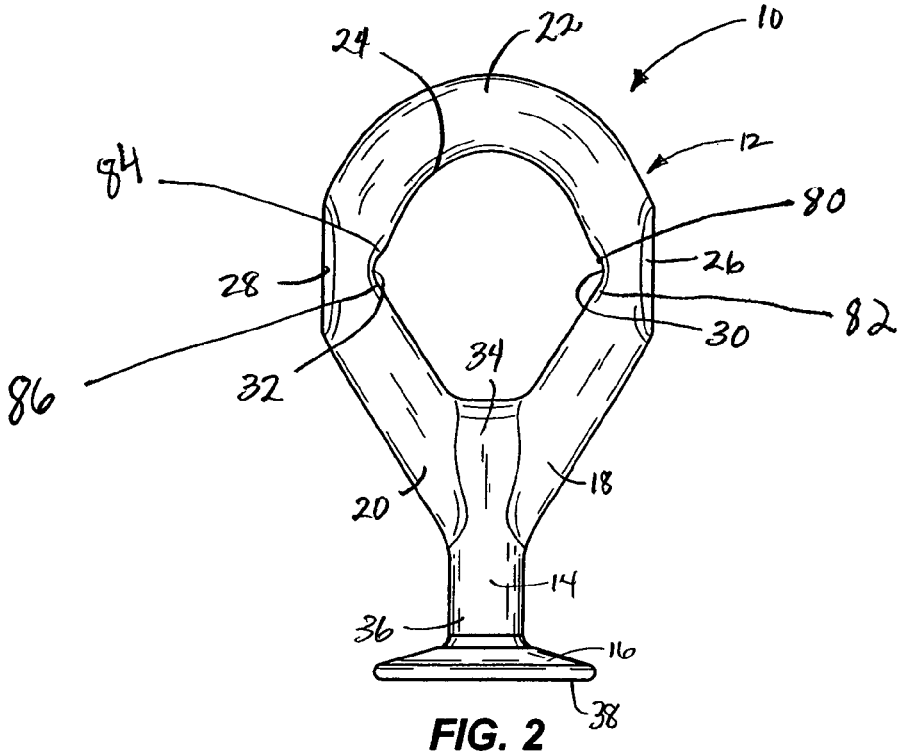
FIG. 2 is a plan view of the concrete anchor of FIG. 1.
Figure 3:
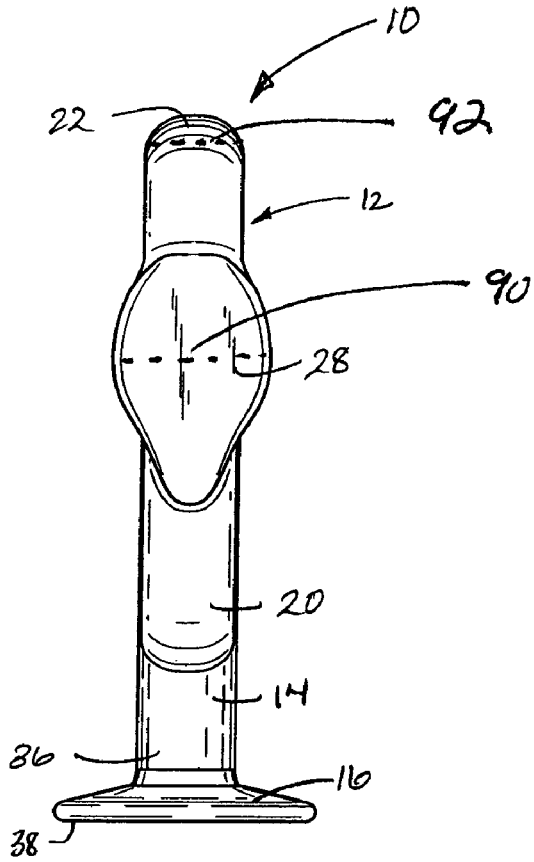
FIG. 3 is a side view of the concrete anchor of FIG. 1.

As best illustrated in FIGS. 1 and 2, the aperture 24 has a generally round shape that is further defined by the first indentation 30 having an upward sloping section 80 and a downward sloping section 82 and the second indentation 32 having an upward sloping section 84 and a downward slopping section 86. The aperture 24 can have any shape necessary, and the shape of the aperture 24 can be at least partially determined by the structure of the lifting hardware used to engage the anchor 10 via the aperture 24. As further illustrated in FIGS. 1 and 2, the aperture 24 is at least partially defined by the upper end 34 of the stem 14. This need not be the case. That is, the aperture 24 can be completely defined by the bar 12. As best illustrated in FIG. 2, the aperture 24 is rounded adjacent the intermediate portion 22 of the bar, and substantially flat adjacent the upper end 34 of the stem 14.

With continued reference to FIG. 2, the first and second flat sides 26 and 28 are positioned directly opposite one another with respect to the aperture 24. In addition, the first and second flat sides 26 and 28 are both centered approximately at the vertical center of the aperture 24, such that the anchor 10 is symmetrical about an imaginary vertical center line. However, the first and second flat sides 26 and 28 do not need to have this arrangement or orientation. That is, the first and second flat sides 26 and 28 can be positioned above or below the vertical center of the aperture 24 without departing from the spirit and scope of the present invention. Furthermore, the first and second flat sides 26 and 28 do not need to be positioned directly opposite one another with respect to the aperture 24. For example, in some embodiments, one of the first flat side 26 and the second flat side 28 can be positioned vertically higher than the other. By way of further example, neither the first flat side 26 nor the second flat side 28 needs to be oriented substantially vertically, but instead can be oriented at an angle with respect to the vertical.

Similarly, the first and second indentations 30 and 32 are positioned directly opposite one another with respect to the aperture 24. The first and second indentations 30 and 32 are also centered approximately at the vertical center of the aperture 24, such that the aperture 24 is symmetrical about an imaginary vertical center line. However, the first and second indentations 30 and 32 need not be positioned approximately at the vertical center of the aperture 24, but instead can be positioned above or below the vertical center of the aperture 24. Furthermore, the first and second indentations 30 and 32 need not be positioned directly on opposite sides of the aperture 24 from one another, and the aperture 24 need not be symmetric about any axis taken through the aperture 24. For example, in some embodiments, one of the first indentation 30 and the second indentation 32 can be positioned vertically above the other and not necessarily directly opposite one another with respect to the aperture 24.

The aperture 24 can comprise at least one of an attachment aperture, a reinforcement bar aperture, a shear plate aperture, a passthrough aperture, and a combination thereof.

An "attachment aperture" as used herein and in the appended claims can comprise an aperture shaped and dimensioned to engage lifting hardware. When the anchor 10 is embedded in a hardened concrete form, the concrete form can be lifted, moved, manipulated and/or maneuvered by engaging an attachment aperture of the anchor 10 with the lifting hardware. Such lifting hardware is well-known to those of ordinary skill in the art, and therefore will not be described in greater detail herein.

A "reinforcement bar aperture" as used herein and in the appended claims can comprise an aperture shaped and dimensioned to receive at least a portion of a reinforcement bar positioned with a concrete form. Such reinforcement bars are well-known in the art. Positioning at least a portion of a reinforcement bar within a reinforcement bar aperture can provide greater stability to the anchor 10 embedded in a concrete form.

A "passthrough aperture" as used herein and in the appended claims can comprise an aperture defined in the anchor 10 and designed to reduce the mass (and weight) of the anchor 10, as compared to a similarly or identically designed anchor without a passthrough aperture. For example, a passthrough aperture can be designed to save at least about 30% of the mass (and weight) of the anchor 10. A passthrough aperture can reduce the cost of transportation and surface treatment of the anchor 10 because of the reduced mass (and weight) of the anchor 10. A passthrough aperture can also provide a more effective coupling between the anchor 10 and concrete, and can improve the strength of the anchor 10, by allowing concrete to fill in at least a portion of the passthrough aperture during pouring of the concrete.

A "shear plate aperture" as used herein and in the appended claims can comprise an aperture that allows a shear plate to be positioned within the shear plate aperture of the anchor 10 to increase the shear resistance between the anchor 10 and concrete in which the anchor 10 is embedded (e.g., during lifting). By forming a shear plate aperture in the anchor 10, it is not necessary to strongly weld a shear-plate to the anchor 10 during manufacturing of the anchor 10 (e.g., during forging of the anchor 10). That is, the shear plate aperture can be adapted to allow at least one shear plate to be positioned (e.g., by sliding) within the shear plate aperture. The shear plate(s) can then optionally be secured in place. For example, the shear plate(s) can be secured within the shear plate aperture by securing with a fastener (e.g., one or more nails, screws, tacks, staples, bolts, etc.), by welding (e.g., by tack welding, etc.), soldering, by a press-fit engagement, by a snap-fit engagement, or by adhering the shear plate(s) within the shear plate aperture with a variety of adhesives known to those of ordinary skill in the art. The shear plate(s) can be coupled to the anchor 10 within the shear plate aperture during manufacturing of the anchor 10 or prior to pouring the concrete in which the anchor 10 is embedded.

By way of example only, in some embodiments, at least a portion of the aperture 24 can comprise a shear plate aperture (e.g., a shear bar or plate can be positioned within a portion of the aperture 24 adjacent the upper end 34 of the stem 14), at least a portion of the aperture 24 can comprise a reinforcement bar aperture (e.g., portions adjacent each of the first and second indentations 30 and 32), at least a portion of the aperture 24 can comprise a passthrough aperture (e.g., a generally central portion of the aperture 24 between the shear plate(s) and the reinforcement bars), and at least a portion of the aperture 24 can comprise an attachment aperture (e.g., a portion adjacent the intermediate portion 22 of the bar 12).

In other embodiments of the present invention, the aperture 24 can comprise an attachment aperture, and the first and second indentations 30 and 32 in the bar 12 further define an engagement between the anchor 10 and lifting hardware.

Figure 5:
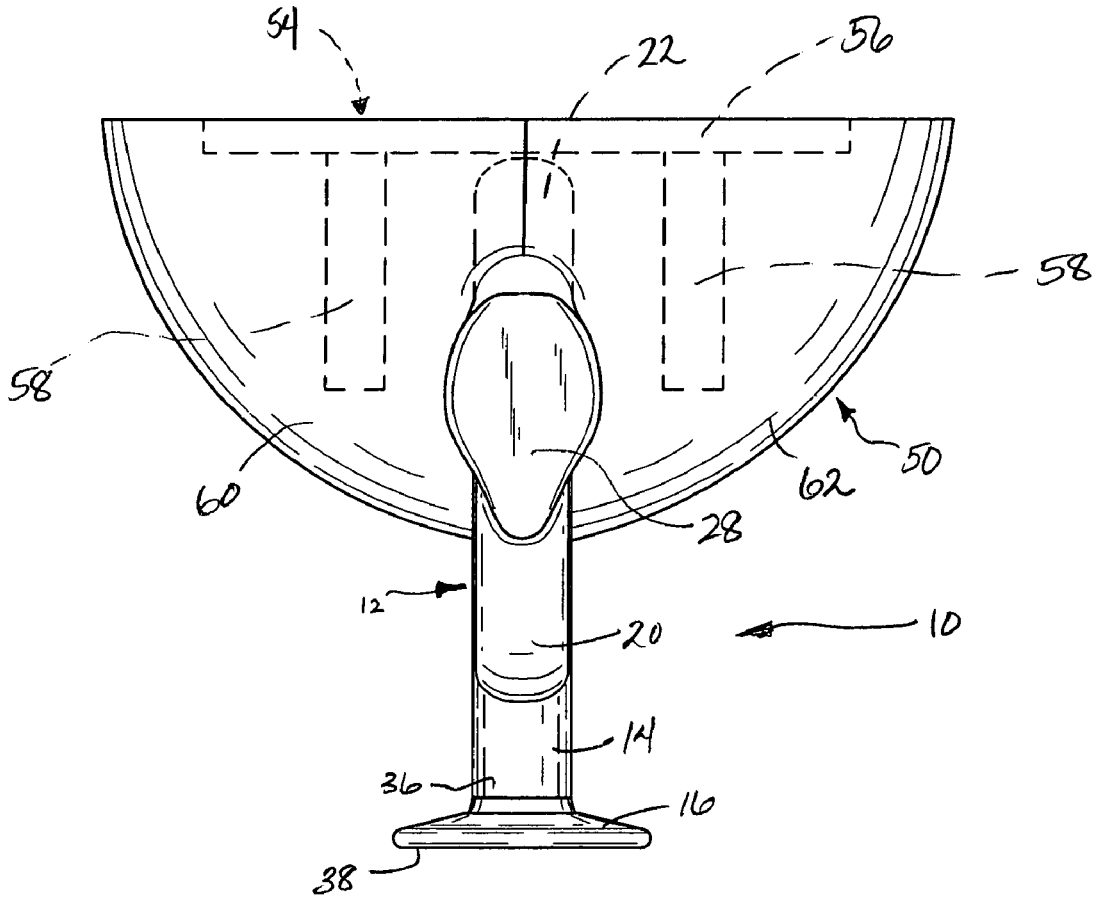
FIG. 5 is a side view of the concrete anchor of FIG. 1, shown with a void former coupled to the concrete anchor.

FIG. 5 illustrates the anchor 10 coupled to a void former 50. The void former 50 can be formed of a variety of materials, including at least one of rubber, plastic, wood, and any other material that is easily removable from the concrete (e.g., after hardening). The anchor 10 and void former 50 can be positioned within a frame or housing (not shown), and concrete can be poured into the frame around the anchor 10 and void former 50 to define a concrete form. The void former 50 can be coupled to the frame with at least one securing device 54. As illustrated in FIG. 5, the securing device 54 can include a plate 56 and bolts 58. However, other securing devices 54 known to those of ordinary skill in the art can be used without departing from the spirit and scope of the present invention. The securing device 54 can be used to maintain the anchor 10 and void former 50 in a proper position relative to the frame throughout the process of creating the concrete form.

The void former 50 illustrated in FIG. 5 includes a first portion 60 and a second portion 62. The first portion 60 and the second portion 62 of the void former 50 are held together to create a sufficiently tight seal between the void former 50 and the anchor 10. The first and second poritons 60 and 62 of the void former 50 can be distinct parts or can be at least partially connected together. The securing device 54 can be used to couple the first portion 60 to the second portion 62. The void former 50 can comprise as few as one portion and as many as desired to create a desired void in the concrete form. Similarly, one or more void formers 50 can be used to create a void in the concrete around the anchor 10.

Reinforcement bars and/or shear plates can be passed through the aperture 24, as described above, before the concrete is poured around the anchor 10. When the concrete is poured into the frame, the area protected by the void former 50 remains free of concrete. When the concrete is hardened, the void former 50 can be removed to reveal a void or recess that has been formed around a portion of the anchor 10. Leaving a portion of the anchor 10 free of concrete allows lifting hardware to be coupled to the anchor 10 via the aperture 24.

The invention claimed is:

1. A concrete anchor comprising:

a bar having a first end, a second end positioned adjacent the first end, and an intermediate portion curved to at least partially define an aperture, the aperture being adapted to engage lifting hardware; and a stem having a first end coupled to the first end and the second end of the bar, and a second end coupled to a foot;

wherein the bar further comprises:

a first indentation having an upward sloping section and a downward sloping section, the first indentation being located on an inner portion of the bar, opposite a first flat side, and a second indentation having an upward sloping section and a downward sloping section, the second indentation being located on an inner portion of the bar, opposite a second flat side.

2. The concrete anchor of claim 1, wherein the bar, the stem and the foot are integrally formed.

3. The concrete anchor of claim 1, wherein the first flat side is defined in an outer portion of the bar and the second flat side is defined in an outer portion of the bar.

4. The concrete anchor of claim 3, wherein the first flat side is positioned opposite the second flat side with respect to the aperture.

5. The concrete anchor of claim 4, wherein the aperture has a vertical height, and wherein the first flat side, the second flat side, the first indentation and the second indentation are positioned generally centrally with respect to the vertical height of the aperture.

6. The concrete anchor of claim 3, wherein the first flat side and the second flat side are oriented substantially vertically.

7. The concrete anchor of claim 1, wherein the first indentation and the second indentation further define the aperture.

8. The concrete anchor of claim 1, wherein the aperture is further defined by the upper end of the stem.

9. The concrete anchor of claim 8, wherein the aperture is substantially curved adjacent the intermediate portion of the bar and substantially flat adjacent the upper end of the stem.

10. The concrete anchor of claim 1, wherein the foot is substantially frustoconical.

11. The concrete anchor of claim 1, wherein the stem is substantially cylindrical.

12. The concrete anchor of claim 1 wherein the intermediate portion of the bar has a cross-section width narrower than the width of the first flat side and the width of the second flat side.

13. The concrete anchor of claim 1 wherein the intermediate portion of the bar is rounded.

14. The concrete anchor of claim 1 wherein the ring-shaped bar has a cross-section width narrower than the width of the first flat side and the width of the second flat side.

15. The concrete anchor of claim 1 wherein the ring-shaped bar is rounded.

16. A concrete anchor comprising:

a ring-shaped bar at least partially defining an aperture therethrough, the ring-shaped bar having a first end, and a second end positioned adjacent the first end;

a first indentation having an upward sloping section and a downward sloping section, the first indentation being located on an inner portion of the bar, opposite a first flat side;

a second indentation having an upward sloping section and a downward sloping section, the second indentation being located on an inner portion of the bar, opposite a second flat side; and a foot coupled to the first end and the second end of the ring-shaped bar.

17. The concrete anchor of claim 16, further comprising a stem having a first end and a second end, the first end of the stem being coupled to the first end of the ring-shaped bar and the second end of the ring-shaped bar, and the second end of the stem being coupled to the foot.

18. The concrete anchor of claim 17, wherein the aperture is further defined by the first end of the stem.

19. The concrete anchor of claim 16, wherein the first flat side is defined in an outer portion of the ring-shaped bar, and the second flat side is defined in an outer portion of the ring-shaped bar.

20. The concrete anchor of claim 19, wherein the first flat side and the second flat side are positioned opposite one another with respect to the aperture.

21. The concrete anchor of claim 19, wherein the first flat side and the second flat side are oriented substantially vertically.

22. The concrete anchor of claim 16, wherein the first indentation and the second indentation are positioned opposite one another with respect to the aperture.

23. The concrete anchor of claim 16, wherein the aperture has a vertical height, and wherein the first indentation and the second indentation are positioned substantially centrally with respect to the vertical height of the aperture.

24. A method of manufacturing a concrete form, the method comprising:

coupling at least one void former to the concrete anchor of claim 14 to form a concrete anchor assembly;

coupling the concrete anchor assembly to a frame;

pouring concrete into the frame to at least partially cover the concrete anchor assembly;

allowing the concrete to harden to form hardened concrete within the frame, the hardened concrete being coupled to at least a portion of the concrete anchor assembly;

removing the at least one void former from the concrete anchor assembly; and removing the hardened concrete from the frame.

* * * * *